United States Patent [19]

O'Neill et al.

[11] Patent Number: 4,896,719

[45] Date of Patent: Jan. 30, 1990

[54] ISOTHERMAL PANEL AND PLENUM

[75] Inventors: Richard F. O'Neill, Carlsbad, Calif.; Robert B. Whitesides, Murrysville, Pa.

[73] Assignee: McDonnell Douglas Corporation, Long Beach, Calif.

[21] Appl. No.: 192,610

[22] Filed: May 11, 1988

[51] Int. Cl.[4] ..... F28F 3/12

[52] U.S. Cl. ..... 165/170; 165/174; 165/907; 165/908

[58] Field of Search ..... 165/174, 902, 908, 170; 350/610

[56] References Cited

U.S. PATENT DOCUMENTS

| | | | |
|---|---|---|---|
| 709,051 | 9/1902 | Schneller | 165/174 |
| 3,844,343 | 10/1974 | Burggraf | 165/109 |
| 3,909,118 | 9/1975 | Schmidt | 350/610 |
| 4,129,119 | 12/1978 | Yoke | 126/424 |
| 4,136,669 | 1/1979 | Lane | 126/450 |
| 4,443,059 | 4/1984 | Wells | 350/610 |

FOREIGN PATENT DOCUMENTS

| | | | |
|---|---|---|---|
| 964356 | 10/1982 | U.S.S.R. | 165/908 |
| 703875 | 2/1954 | United Kingdom | 165/908 |

OTHER PUBLICATIONS

"Efficient Air Cooling Method Based on a Porous Body", by V. P. Kirillov et al., Jun. 1981, from *Pribory: Tekhnika Eksperimenta, vol. 23, No. 6, Nov.-Dec. 1980, pp. 188-190.*

*Primary Examiner*—Martin P. Schwadron
*Assistant Examiner*—Allen J. Flanigan
*Attorney, Agent, or Firm*—Ben J. Yorks; George W. Finch; John P. Scholl

[57] ABSTRACT

A plenum in combination with a heat exchange panel and a panel structure having a large number of closely spaced orifices of equal size. The plenum area relative to that of the orifice area is such that a pressure head in the plenum is maintained to provide a constant flow of heat exchange medium from the plenum through the orifices to the heat exchange panel.

8 Claims, 1 Drawing Sheet

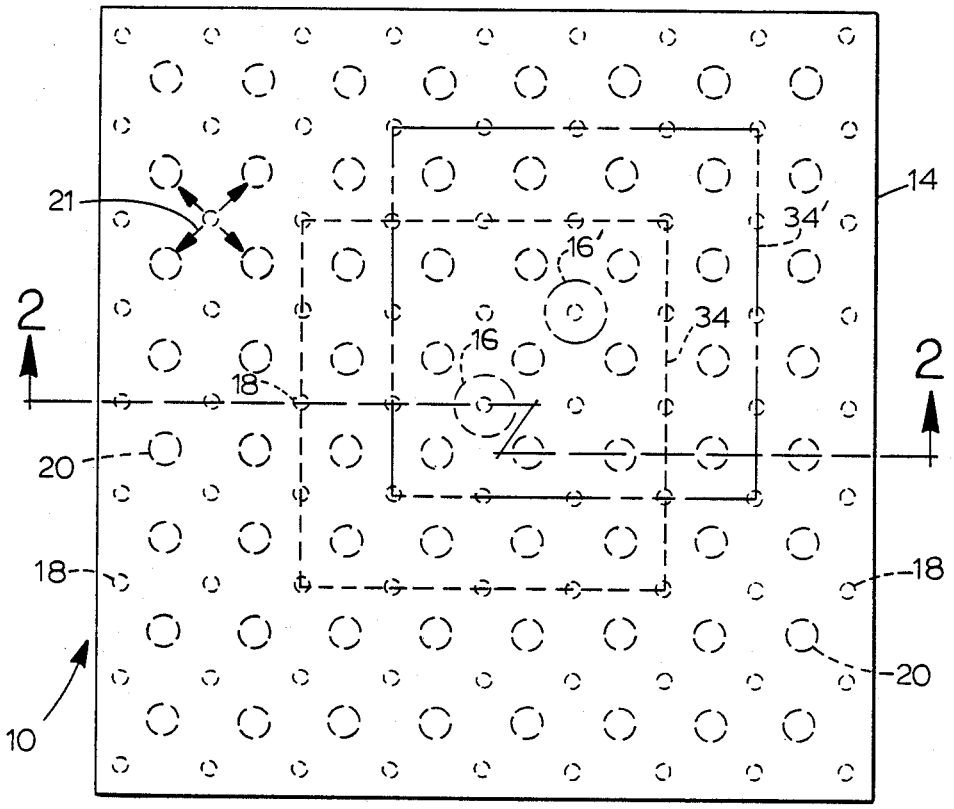
fig.1
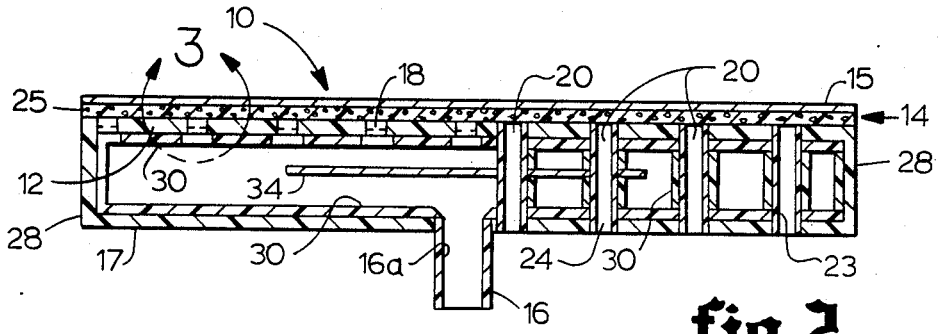
fig.2
fig.3
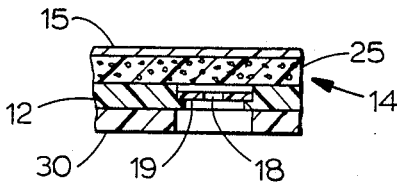

ISOTHERMAL PANEL AND PLENUM

BACKGROUND OF THE INVENTION

The present invention relates to an extended panel structure which can provide isothermal or near isothermal panel surface conditions, and an isobaric plenum manifold structure for delivering a heat exchange medium to the panel structure.

It is difficult to maintain uniform temperature (near-isothermal conditions) over the entire area of an extended heat exchange surface by means of a relatively low rate volumetric flow of heat exchange medium. If the panel were to be flooded with massive amounts of the medium to ensure distribution of the medium over the area of the panel, the system would be prohibitively inefficient. If the panel is not flooded, the medium tends not to flow evenly, thereby producing unacceptable thermal gradients in the panel.

Another cause of non-uniform thermal conditions is the fact that environmental conditions external to the panel may be different from that desired for the panel, ie. the edges of the panel may be warmer or colder than the center portion of the panel.

It is therefore a primary objective of the present invention to provide effective control of the temperature of an extended planar heat exchange surface, while at the same time maintaining near isothermal conditions of surface temperature.

BRIEF SUMMARY OF THE INVENTION

The present invention is directed to the use of a plenum-type manifold structure having a large number of identically configured, closely and equally spaced discharge orifices, to deliver a heat exchange medium uniformly through the orifices when a uniform pressure head is maintained in the plenum. The orifices, being identical in size, are sized to maintain the uniform pressure head. This is accomplished by relating the volume area of the plenum to the nozzle area of the identical orifices in a manner that causes the dominant restriction of medium flow to be in the orifices. The orifices direct the medium to an extended area heat exchange panel having an extended surface area for heating or cooling purposes. Medium flow is constant as long as the flow supplied to the plenum is sufficient to maintain the head. As discussed in detail hereinafter, surface temperature is controlled by the delivery temperature of the medium.

BRIEF DESCRIPTION OF THE DRAWING

The objectives and advantages of the invention will be best understood from consideration of the following detailed description and the accompanying drawing, in which:

FIG. 1 of is a plan view of a surface of a heat exchange panel, and an orifice panel and plenum located beneath the exchange panel. The orifice panel has closely and equally spaced and sized orifices for delivering a heat exchange medium to the heat exchange panel;

FIG. 2 is a sectional view of the structure of FIG. 1 taken along lines II—II; and FIG. 3 is a sectional view of the panel structure taken along the circular line of FIG. 2.

PREFERRED EMBODIMENT

Referring now to FIG. 2 of the drawing, a plenum/-manifold structure 10 is shown in sectional view. The manifold portion of the structure comprises an orifice panel 12 located on the input side of a heat exchange panel 14, shown in plan view in FIG. 1. As shown in FIG. 2, panel 14 comprises an outer metal skin 15, such as a sheet or plate of aluminum, and a rigid panel of expanded foam material 25. The two are bonded together, as discussed in detail below. Orifice panel 12 forms an upper wall of the plenum of 10, as depicted in FIG. 2. Opposite panel 12 is a lower wall 17. A pipe or conduit 16 is located in fluid communication with the plenum via an opening **16*a* provided in wall 17. Conduit 16 is suitably connected to the wall for directing a heat exchange medium into the plenum from the single location of 16**.

Panel 12 is provided with a plurality of orifices 18 hereinafter referred to as "discharge orifices". Each orifice resides in an orifice structure 19 (FIG. 3) suitably provided or secured in the structure of panel 12, and is surrounded by a plurality of openings 20 (FIG. 1) provided in panel 12. Hereinafter, openings 20 are referred to as "exhaust openings".

FIG. 1 shows in plan view the solid face and outward surface of heat exchange panel 14. In addition, FIG. 1 shows in hidden outline the plurality of orifices 18 and openings 20 provided in panel 12. As shown, the orifices and openings are spread uniformly across the breadth of panel 12, the plurality of openings 20 being located intermediate of and in close proximity to orfices 18. Arrows 21 of FIG. 1 depict the travel of a heat exchange medium as it exits an orifice 18 and divides into four paths to exhaust through openings 20. Orifices 18 are identical in size and are sized to constitute the main pressure drop in the system. The large number of orifices 18, however, make the distances between them relatively short and hence the distance between the orifices 18 and exhaust openings 20 are short (and equal). Since the discharge orifices 18 provide the major pressure drop in the system, openings 20 are shown larger than the orifices 18, as the purpose of the openings 20 is to simply exhaust the medium from the system.

Discharge orifices 18 are also located along the edges of panel 12, see FIG. 1. These orifices 18 function to maintain thermal control along the edges of the heat exchange panel 14, and are thus an important feature of the system. As discussed earlier, the edges of the heat exchange panel 14 may be influenced by conditions external to the panel. The discharge orifices 18 located along the edges of the manifold, ensure a flow of the heat exchange medium to the edges of heat exchange panel 14 that is the same as the flow to the remaining portions of the heat exchange panel 14. In this manner, panel edges will not be cooler or warmer than the center portion of the panel.

In viewing section line II—II in FIG. 1, it will be noted that the line passes through the center of orifices 18 and exhaust openings 20. In FIG. 2, the discharge orifices in panel 14 12 are visible on the left, while the exhaust openings in the panel 12 are visible on the right. As seen further in FIG. 2, each exhaust opening 20 is provided with a tubular structure 23 that extends between walls 12 and 17 of the plenum. In this manner, a heat exchange medium directed into the plenum through conduit 16 travels up through orifices 18 to panel 14, then returns from 14 to exhaust down through the plenum via tubes 23. Openings 24 are provided in wall 17 and located in registry with tubes 23.

Plenum 10 is enclosed on its four sides by a wall structure 28 such that the plenum is defined by such a wall structure in combination with the upper and lower walls of 12 and 17. Preferably, walls 12, 17 and 28, orifice structures 19 and tubes 23 are made of a rigid insulating material, such as a polycarbonate, so that temperature conditions outside of the plenum will not induce temperature gradients in the plenum and in panel 12.

The surfaces of walls 12, 17 and 28, and tubes 23 as shown in FIG. 2, are provided with layers of insulation 30 that serve, again, to maintain near-isothermal conditions in the plenum. With the discharge orifices 18 located along edges of panel 12, and functioning in the manner described above, in combination with the insulation 30 of the plenum and exhaust tubes 23, the extended area of panel 14 is uniformly heated or cooled by the medium directed to it through orifices 18.

The outer metal skin 15 of heat exchange panel 14 is brazed or otherwise bonded to a rigid structure of high-thermal-conductivity expanded foam material 25. Metal skin 15 and foam 25 thus reside in intimate thermally conductive contact with each other. The expanded nature of the foam material 25 provides the same with open pores that permit free flow of a heat exchange medium through the pores and material. A foam material 25 is preferred for panel 14 because of its open pores and the extensive surface areas that are available for contact by the heat exchange medium. Suitable foam materials 25 include aluminum, silicon carbide, alumina or other ceramic materials or polymers and other non-metals.

Foam panel 14 is shown disposed against panel 12 in FIGS. 2 and 3, such that the orifices 18 and openings 20 of panel 12 are in direct communication with the pores of foam material 25.

Located in the path of inlet conduit 16 in plenum 10 is a solid baffle 34. Baffle 34 serves to spread out the flow of the incoming medium in the enclosed volume of the plenum. In this manner, the incoming medium does not flow directly to those orifices 18 located opposite conduit 16. In this manner, the baffle 34 assists in reducing temperature gradients in the plenum, as it spreads out the incoming medium within the plenum.

Further, baffle 34 (and conduit 16) need not be located in the center of the plenum. As shown in phantom outline in FIG. 1, the baffle (34') and conduit (16') can be located off-center. In addition, the shape of the baffle 34 need not be square or perfectly planar. What is required is that a baffle 34 be interposed between conduit 16 and orifice panel 12 to prevent direct flow of the medium to discharge orifices 18 opposite the conduit 16 to assist in reducing thermal gradients within the plenum.

Orifice structures 19 are preferably made from thin gauge material to provide "sharp edge orifices" that are effective to direct thin columns of the heat exchange medium to an area of the heat exchange panel 14 that is immediately opposite that of the orifices 18. In this manner, the medium travels directly and evenly to the panel 14 to evenly heat or cool the extended area of the panel 14.

The uniformity of the flow rate from plenum 10 is effected by providing a large area (volume) plenum, relative to orifice 18 area, to serve as a constant pressure reservoir for orifices 18. In this manner, the flow velocity in the plenum is sufficiently small so that the pressure changes throughout the plenum are small compared to the pressure loss for the fluid exiting through the orifices 18. The orifices, being of equal size and supplied at uniform pressure, will deliver uniform quantities of heat exchange medium to panel 14. The flow of the medium to panel 14 is thereby uniform, and the equally spaced, sharp edge orifices 18 ensure that the cooling or heating effected by the panel 14 is uniform over the entire extended area of the panel 14.

Since the size of the orifices 18 is based upon mass flow requirements, and the area ratio of plenum to orifice 18 is a specified one, a high pressure head is not needed in the plenum to insure such uniform flow. Rather, a low pressure head (e.g. less than ten inches of water) is sufficient to direct the medium uniformly to the entire area of panel 14 when using air as the medium, with a mass flow of twenty pounds per hour per square foot of manifold area.

While the invention has been described in terms of preferred embodiments, the claims appended hereto are intended to encompass all embodiments which fall within the spirit of the invention.

What is claimed is:

1. A heat exchanger that controls the temperature of an extended heat exchange surface, comprising:

a panel having a plurality of discharge orifices defining passages closely spaced apart throughout the area of the panel for receiving a flow of heat exchange medium, a plurality of exhaust openings provided in the panel and located in a manner that each discharge orifice is surrounded by a plurality of exhaust openings located in close proximity to each discharge orifice, an extended area heat exchange panel providing the extended heat exchange surface, said heat exchange panel comprising a porous material bonded to a metal sheet, said porous material being located adjacent to the orifice panel, wherein said passages defined by said discharge orifices do not penetrate said porous material, and a plenum disposed adjacent the orifice panel to provide a constant supply of heat exchange medium to the discharge orifices.

2. The heat exchanger of claim 1 in which the orifice panel includes thin gauge material such that the plurality of discharge orifices function as sharp edge orifices for directing the heat exchange medium toward the extended heat exchange panel.

3. The heat exchanger of claim 1 in which the plenum is insulated to minimize thermal gradients in the medium.

4. The heat exchanger of claim 1 in which the plenum is made from an insulating material.

5. The heat exchanger of claim 1 including insulating tubes extending through the plenum from the exhaust openings in the orifice panel to exhaust the heat exchange medium from the heat exchange panel through the plenum.

6. The heat exchanger of claim 1 in which the discharge orifices have an area to plenum volume ratio that provides a uniform pressure head in the plenum when the heat exchange medium is directed to the plenum.

7. The heat exchanger of claim 1 in which a single inlet is provided in a wall of the plenum located opposite the plurality of discharge orifices in the orifice panel, and baffle means located between the inlet opening and at least a portion of the plurality of discharge orifices in the panel.

8. The heat exchanger in claim 1 in which the porous material is an expanded foam material.

* * * * *